US011414899B2

(12) United States Patent
Ottino et al.

(10) Patent No.: US 11,414,899 B2
(45) Date of Patent: Aug. 16, 2022

(54) POWER LATCH ASSEMBLY WITH IMPACT PROTECTION

(71) Applicant: MAGNA CLOSURES INC., Newmarket (CA)

(72) Inventors: Franco Giovanni Ottino, San Giuliano Terme (IT); Carlo Quartieri, Pontedera (IT); Enrico Boeri, Camaiore (IT)

(73) Assignee: MAGNA CLOSURES INC., Newmarket (CA)

( * ) Notice: Subject to any disclaimer, the term of this patent is extended or adjusted under 35 U.S.C. 154(b) by 679 days.

(21) Appl. No.: 16/285,293

(22) Filed: Feb. 26, 2019

(65) Prior Publication Data

US 2019/0264474 A1 Aug. 29, 2019

Related U.S. Application Data

(60) Provisional application No. 62/635,917, filed on Feb. 27, 2018.

(51) Int. Cl.

| | |
|---|---|
| ***E05B 81/16*** | (2014.01) |
| ***E05B 77/12*** | (2014.01) |
| ***E05B 81/34*** | (2014.01) |
| ***E05B 15/00*** | (2006.01) |
| *E05B 47/00* | (2006.01) |

(52) U.S. Cl.

CPC ..... *E05B 81/16* (2013.01); *E05B 15/0046* (2013.01); *E05B 77/12* (2013.01); *E05B 81/34* (2013.01); *E05B 2047/002* (2013.01)

(58) Field of Classification Search

CPC ..... E05B 77/04; E05B 77/06; E05B 77/12; E05B 17/0062; E05B 77/02; E05B 83/36; E05B 15/0046; E05B 81/16; E05B 81/34

See application file for complete search history.

(56) References Cited

U.S. PATENT DOCUMENTS

| | | | | |
|---|---|---|---|---|
| 5,584,516 | A | 12/1996 | Cetnar | |
| 6,581,988 | B1 | 6/2003 | Milhail | |
| 7,264,283 | B2 | 9/2007 | Stoof et al. | |
| 7,287,785 | B2 | 10/2007 | Schupp et al. | |
| 7,607,702 | B2 | 10/2009 | Pereverzev | |
| 8,079,631 | B2 * | 12/2011 | Higgins | E05B 77/04 296/146.1 |
| 8,235,451 | B2 * | 8/2012 | Jordan | E05B 83/36 296/146.1 |
| 8,827,330 | B2 | 9/2014 | Jankowski et al. | |
| 8,967,682 | B2 | 3/2015 | Jankowski et al. | |
| 9,428,943 | B2 | 8/2016 | Mitchell et al. | |
| 10,214,945 | B2 | 2/2019 | Cetnar | |

(Continued)

FOREIGN PATENT DOCUMENTS

| | | | |
|---|---|---|---|
| CN | 203846892 | U | 9/2014 |
| CN | 104245415 | A | 12/2014 |

(Continued)

*Primary Examiner* — Mark A Williams

(74) *Attorney, Agent, or Firm* — Dickinson Wright PLLC

(57) ABSTRACT

A latch assembly and system therewith configured for retaining a closure panel of a motor vehicle in a closed position relative to a vehicle body during and upon the latch assembly experiencing an impact force during a crash condition and prior to the latch assembly having been intentionally actuated to move to an unlatched state.

14 Claims, 14 Drawing Sheets

(56) References Cited

U.S. PATENT DOCUMENTS

| | | | | |
|---|---|---|---|---|
| 2001/0022456 | A1* | 9/2001 | Kitagawa | B62D 25/025 296/187.12 |
| 2006/0208508 | A1 | 9/2006 | Lucas et al. | |
| 2006/0261603 | A1 | 11/2006 | Cetnar et al. | |
| 2007/0029835 | A1* | 2/2007 | Herline | E05B 77/04 296/146.1 |
| 2011/0258935 | A1* | 10/2011 | Heller | B60J 5/0451 49/502 |
| 2013/0056997 | A1 | 3/2013 | Mittelbach et al. | |
| 2014/0284940 | A1* | 9/2014 | Rosales | E05B 77/04 292/92 |
| 2014/0312632 | A1* | 10/2014 | Nagaoka | E05B 79/08 292/200 |
| 2015/0069764 | A1* | 3/2015 | Kerr, III | E05B 85/16 292/139 |
| 2015/0167362 | A1* | 6/2015 | Kang | E05B 77/06 292/336.3 |
| 2015/0330116 | A1 | 11/2015 | Dente | |
| 2016/0002959 | A1 | 1/2016 | Javadzedeh et al. | |
| 2017/0089103 | A1 | 3/2017 | Ottino et al. | |
| 2019/0128025 | A1* | 5/2019 | Ishikawa | E05B 77/04 |
| 2019/0284845 | A1* | 9/2019 | Fraley | E05B 77/04 |
| 2019/0301208 | A1* | 10/2019 | Cimpean | E05B 77/04 |
| 2021/0010302 | A1* | 1/2021 | Anderson | E05B 77/12 |
| 2021/0238895 | A1* | 8/2021 | Kovie | B60J 5/0433 |
| 2021/0254373 | A1* | 8/2021 | Suzaki | E05B 85/04 |

FOREIGN PATENT DOCUMENTS

| | | | |
|---|---|---|---|
| CN | 204386303 | U | 6/2015 |
| DE | 102005016488 | | 10/2006 |
| DE | 102007007941 | A1 | 8/2008 |
| DE | 202009011000 | U1 | 10/2009 |
| DE | 202016102209 | U1 | 9/2017 |
| JP | H1096357 | A | 4/1998 |
| KR | 100836121 | B1 | 6/2008 |
| WO | WO2014138911 | A1 | 9/2014 |

* cited by examiner

POWER LATCH ASSEMBLY WITH IMPACT PROTECTION

CROSS-REFERENCE TO RELATED APPLICATION

This application claims the benefit of U.S. Provisional Application Ser. No. 62/635,917, filed Feb. 27, 2018, which is incorporated herein by reference in its entirety.

FIELD

The present disclosure relates generally to power door systems for motor vehicles. More particularly, the present disclosure is directed to a power door system equipped with a power latch assembly operable for powered holding and powered releasing of a ratchet relative to a pawl of the power latch assembly.

BACKGROUND

This section provides background information related to the present disclosure which is not necessarily prior art.

In view of increased consumer demand for motor vehicles equipped with advanced comfort and convenience features, many current vehicles are now provided with power actuated latch assemblies operable via passive keyless entry systems to permit powered locking and powered release of the latch assembles without the use of traditional manual entry mechanisms. Although such power actuated latch assemblies provide desired functionality under normal operating conditions, further advancements are desired to ensure features of the power actuated latch assemblies retain their intended position and functionality upon being impacted, such as in a crash condition.

In view of the above, there remains a desire to develop alternative power door latch assemblies which address and overcome limitations associated with known power door latch assemblies to provide enhanced functionality upon being impacted while minimizing cost and complexity associated with such advancements.

SUMMARY

This section provides a general summary of the present disclosure and is not a comprehensive disclosure of its full scope or all of its features, aspects and objectives.

It is an aspect of the present disclosure to provide a latch assembly for selectively unlatching a vehicle closure panel for desired movement of the closure panel from a closed position to an open or deployed positions relative to a vehicle body when desired and for retaining the closure panel in a closed position relative to the vehicle body when desired.

It is a further aspect of the present disclosure to provide a latch assembly for retaining the closure panel in a closed position relative to the vehicle body upon the power latch assembly experiencing an impact force during a crash condition and prior to the power latch assembly having been intentionally signaled to move to an unlatched state.

In accordance with these and other aspects, a latch assembly for a motor vehicle having a vehicle body defining a door opening and a vehicle swing door pivotably connected to the vehicle body for swing movement along a swing path between open and closed positions relative to the door opening is provided. The power latch assembly of the present disclosure includes a release chain component configured for release from a ratchet holding position whereat a ratchet is maintained in latched engagement with a striker to maintain the swing door in the closed position to a ratchet releasing position whereat the ratchet is moved out of latched engagement from the striker to allow the swing door to be moved from the closed position to the open position. The latch assembly includes a mechanical feature that prevents inadvertent movement of the release chain component from the ratchet holding position to the ratchet releasing position upon the latch assembly having been impacted in a crash condition without first having been intentionally actuated to move to the ratchet releasing position.

In accordance with another aspect, the release chain component is a pawl.

In accordance with another aspect, the latch assembly of the motor vehicle is a power latch assembly and has a housing supporting an electric motor arranged to drive a worm gear configured in meshed engagement with a power release gear, such that rotation of the power release gear via the selective rotation of the worm gear causes the pawl to move between a ratchet holding position and a ratchet releasing position. The power latch assembly further includes a mechanical feature in the form of an anti-rotation member fixed to the housing, wherein the anti-rotation member is maintained in a non-contacting, clearance relation with the power release gear during normal operating condition of the motor vehicle and is brought into locked engagement with the power release gear upon the housing being deformed, elastically and/or plastically, such as upon being impacted in a crash condition, whereat the anti-rotation member prevents unwanted, inadvertent rotation of the power release gear, thereby preventing unwanted, inadvertent movement of the pawl from the ratchet holding position to the ratchet releasing position during a crash condition. Accordingly, the swing door is maintained in its closed position via interaction of pawl with ratchet until desired to be intentionally move the swing door to its open position.

In accordance with a further aspect, the anti-rotation member can be provided as a separate piece of material fixed to the housing, and can further be formed having teeth configured to mesh with teeth of the power release gear upon the latch assembly being impacted in a vehicle crash condition.

In accordance with a further aspect, the anti-rotation member can be provided as an economically manufactured piece of polymeric material.

In accordance with a further aspect, the anti-rotation member can be provided as a molded rubber material.

In accordance with yet a further aspect, the pawl can be provided having an elongate extension member extending outwardly from a center-of-rotation axis of the pawl, with the elongate extension member having a free end region projecting beyond a radial axis extending through the center-of-rotation axis of the pawl toward an outer panel of the swing door most likely to be impacted in a vehicle crash condition, such that impact of the outer panel of the swing door in a vehicle crash condition causes the free end region to be impacted to bias the pawl in an over-center, ratchet holding direction of rotation, thereby preventing the pawl from being inadvertently moved in the ratchet releasing direction.

In accordance with yet a further aspect, the pawl can have a generally C-shaped body portion with one end region of the generally C-shaped body portion extending from a center-of-rotation axis in a first direction to provide an active region configured for operable engagement with a ratchet while in a ratchet holding position to maintain the ratchet in a closed position and for operable disengagement from the ratchet while in a ratchet releasing position to allow the ratchet to move to an open position, and another of the end regions of the generally C-shaped body portion extending from the center-of-rotation axis in a second direction, different from the first direction, to provide an inactive region configured to bias the pawl toward the ratchet holding position in a vehicle side-impact crash condition.

In accordance with yet another aspect, a method of preventing a ratchet of a power latch assembly of a motor vehicle swing door from inadvertently moving from a striker capture position, whereat the ratchet is maintained in latched engagement with a striker to maintain the vehicle swing door in a closed position, to a striker release position, whereat the ratchet is moved out of latched engagement from the striker to allow the swing door to be moved from the closed position to the open position, during a crash condition of a motor vehicle is provided. The method includes configuring a mechanical feature within a housing of the power latch assembly to be impacted upon the housing being deformed by a force during the crash condition. Further, configuring the impacted mechanical feature to prevent inadvertent movement of a pawl from a ratchet holding position, whereat the ratchet is maintained in latched engagement with the striker, to a ratchet releasing position, whereat the ratchet is moved out of latched engagement from the striker.

In accordance with yet another aspect, the method can include providing the mechanical feature including an anti-rotation member and fixing the anti-rotation member to the housing in clearance relation with a power release gear configured to move the pawl between the ratchet holding position and the ratchet releasing position during a normal operating condition of the motor vehicle prior to the housing being deformed by the force in a crash condition. Further, configuring the anti-rotation member to be brought into engagement with the power release gear upon the housing being deformed by the force in the crash condition, whereat the anti-rotation member inhibits rotation of the power release gear, thereby inhibiting inadvertent movement of the pawl from the ratchet holding position to the ratchet releasing position.

In accordance with yet another aspect, the method can include providing the anti-rotation member including teeth configured to mesh with teeth of the power release gear upon the housing being deformed to enhance the prevention of rotation of the power release gear, thereby enhancing the prevention of inadvertent movement of the pawl from the ratchet holding position to the ratchet releasing position.

BRIEF DESCRIPTION OF THE DRAWINGS

These and other aspects, features, and advantages of the present disclosure will be readily appreciated, as the same becomes better understood by reference to the following detailed description when considered in connection with the accompanying drawings wherein.

DETAILED DESCRIPTION OF EXAMPLE EMBODIMENTS

Figure 1A:
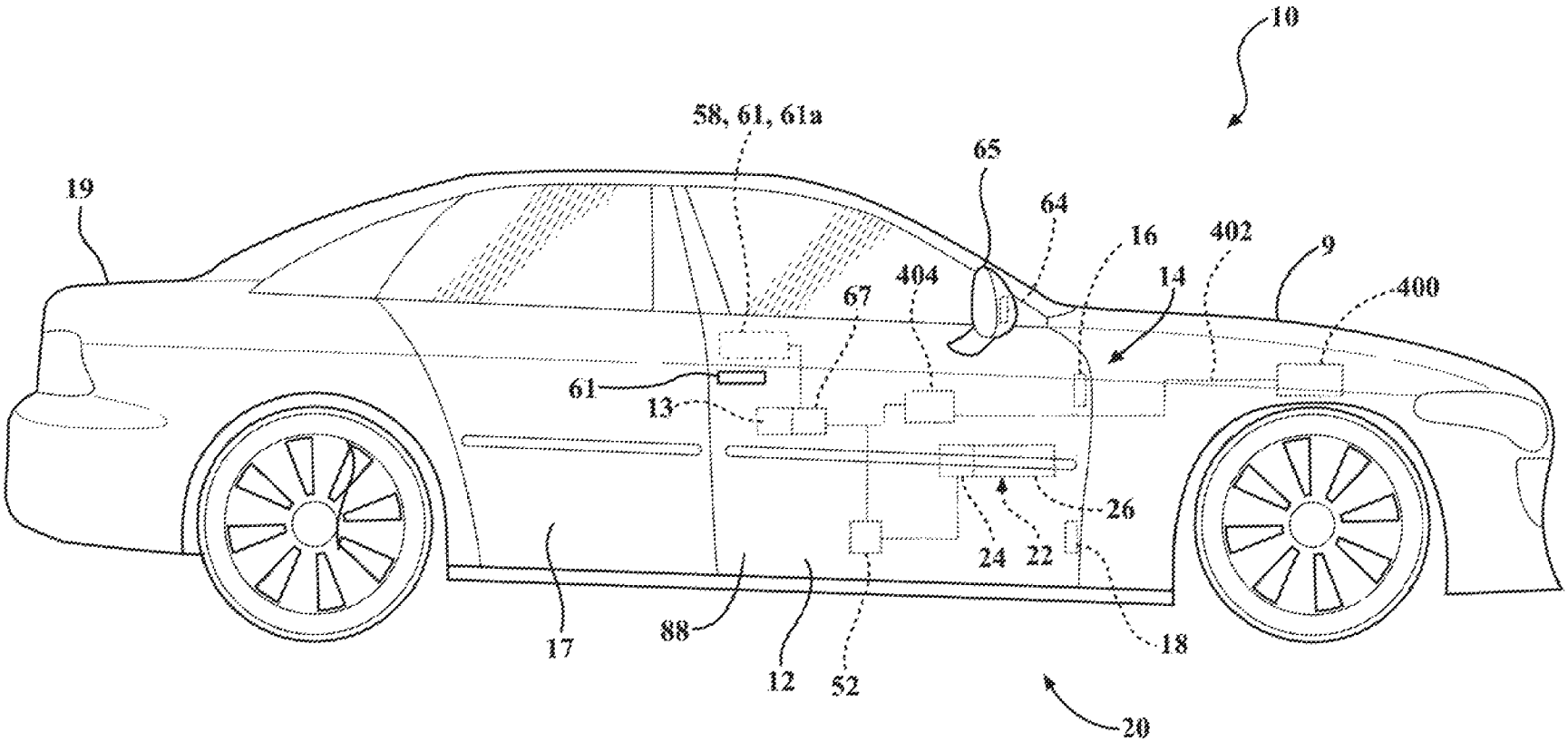
FIG. 1A illustrates an example motor vehicle equipped with a power door actuation system situated between a front passenger swing door and a vehicle body and which is configured to include a power latch assembly in accordance with one aspect of the disclosure.

In general, example embodiments of a power door actuation system including a power latch assembly constructed in accordance with the teachings of the present disclosure will now be disclosed. The example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail, as they will be readily understood by the skilled artisan in view of the disclosure herein.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom", and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

Referring initially to FIG. 1A, an example motor vehicle 10 is shown to include a first closure panel, shown by way of example and without limitation as a front passenger swing door, referred to hereafter simply as swing door 12, pivotally mounted to a vehicle body 14 via an upper door hinge 16 and a lower door hinge 18 which are shown in dashed lines. In accordance with the present disclosure, a power door actuation system 20 is associated with the swing door 12, and in accordance with a preferred configuration, power door actuation system 20 includes a power latch assembly 13, a vehicle door electric control unit (ECU) 52, and can also be configured with a power-operated swing door actuator 22 secured within an internal cavity of passenger door 12 for coordinated control of the opening and closing of the door 12, if desired. The motor vehicle 10 illustrated in FIG. 1A may be provided including mechanically actuatable outside vehicle door handles 61 and inside door handles 61*a* on the vehicle door 12, an example of which is described herein below and illustrated in FIGS. 1A-1C. In accordance with an aspect of the disclosure, the power latch assembly 13 is configured to retain the swing door 12 in a closed position relative to the vehicle body 14 upon the vehicle body 14 and power latch assembly 13 experiencing an influence, such as for example an impact force during a crash condition, prior to the power latch assembly 13 having been intentionally signaled to move to an unlatched state. Accordingly, the power latch assembly 13 resists inadvertent, unintended opening of the swing door 12 upon experiencing an impact force, with the power latch assembly 13 being further configured to allow the swing door 12 to be intentionally opened subsequent to being impacted, as discussed in further detail below.

Figure 1B:
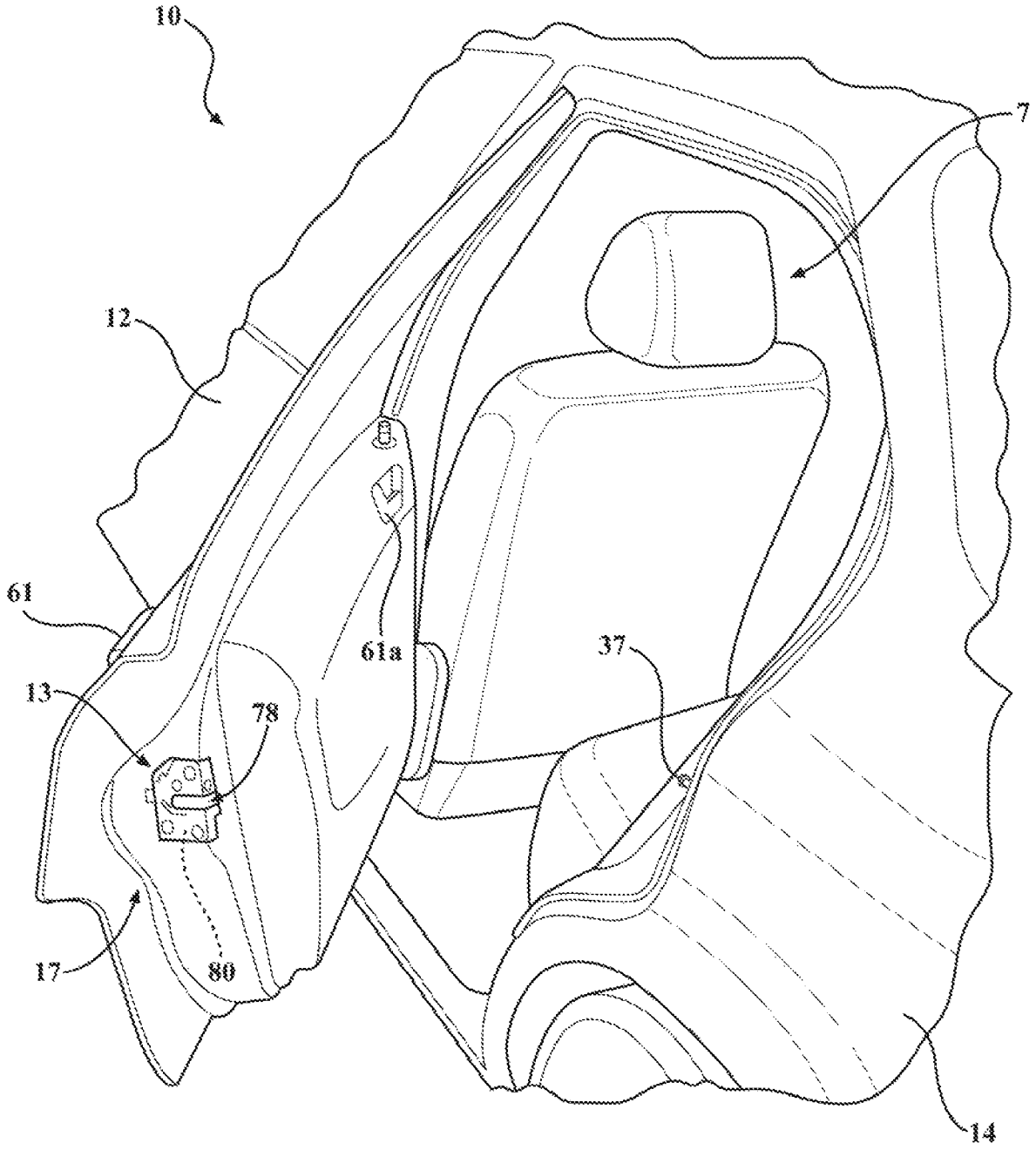
FIG. 1B is a partial perspective view showing the power latch assembly installed in a passenger swing door associated with the vehicle shown in FIG. 1A.

Each of upper door hinge 16 and lower door hinge 18 include a door-mounting hinge component and a body-mounted hinge component that are pivotably interconnected with one another by a hinge pin or post. While power door actuation system 20 is only shown in FIG. 1A in association with front passenger door 12, those skilled in the art will recognize that the power door actuation system 20 and power latch assembly 13 thereof can also be associated with any other door, such as rear passenger doors 17 as shown in FIG. 1B, or also be associated with other closure panels, such as a liftgate (not shown), a hood 9, or a decklid 19. Also, while the door 12 is illustrated herein as being pivotally mounted to the vehicle body 14 for rotation relative to a vertical or generally vertical axis extending through upper and lower hinges 16, 18, it may be configured for rotation about a horizontal axis as would be the case for a liftgate, or other offset (oblique) axis, or the like. For greater clarity, the vehicle body 14 is intended to include the 'non-moving' structural elements of the vehicle 10, such as the vehicle frame, structural support pillars and members, and body panels.

Figure 1C:
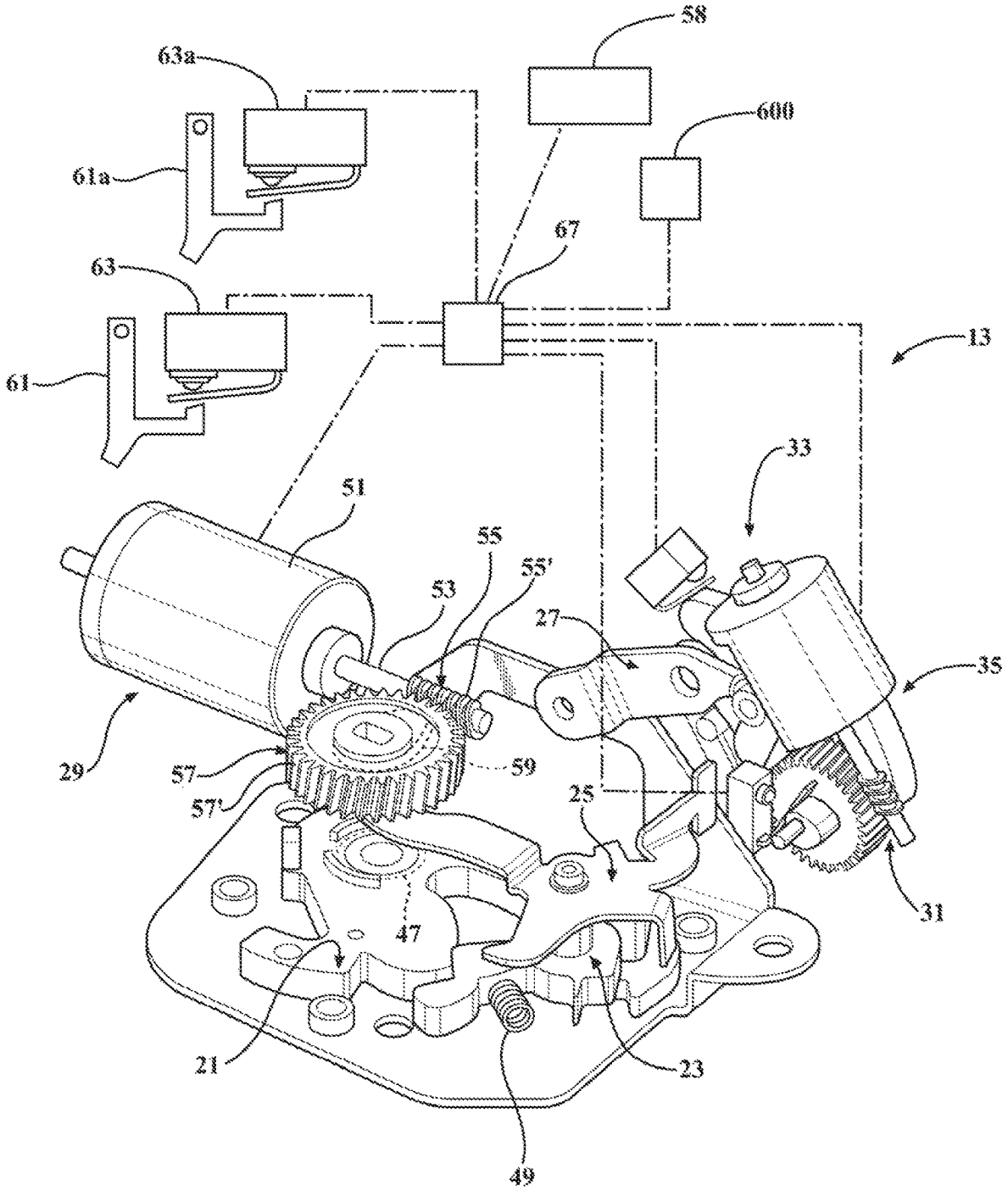
FIG. 1C illustrates an example embodiment of a power latch assembly in accordance with one aspect of the disclosure with various components removed for clarity purposes only.

Referring to FIGS. 1B and 1C, shown is a non-limiting embodiment of power latch assembly 13 for vehicle doors 12, 17 of vehicle 10. Power latch assembly 13 can be positioned on vehicle door 12, 17 and arranged in a suitable orientation to engage and retain a striker 37, mounted on vehicle body 14, when door 12, 17 is closed. Power latch assembly 13 includes a latch mechanism having a ratchet 21 and a release chain component, such as a pawl 23, a latch release mechanism having a pawl release lever 25, an inside door release mechanism having an inside release lever 27, a power release actuator 29 for controlling powered actuation of the latch release mechanism, and a power lock actuator 31 having a lock mechanism 33 and an electric lock motor 35, which are illustratively shown for forming a release chain for holding or releasing the ratchet 21 as now described. Ratchet 21 is moveable between two striker capture positions including primary or fully closed position (shown in FIG. 1C) and secondary or partially closed position (not shown) whereat ratchet 21 retains striker 37 against being fully released. Ratchet 21 is also moveable to a striker release position (FIG. 1B) whereat ratchet 21 permits release of striker 37 from a fishmouth 78 provided by a latch housing 80 of primary latch assembly 13. Referring to FIG. 1C, a ratchet biasing member, schematically shown in dashed line at 47, such as a spring, is provided to normally bias ratchet 21 toward its striker release position. Pawl 23 is movable between at least one ratchet holding position (FIG. 1C) whereat pawl 23 holds ratchet 21 in its closed, striker capture position(s), wherein swing door 12 is maintained in a closed state, also referred to as closed position, thereby being restrained against being fully opened, and a ratchet releasing position whereat pawl 23 permits ratchet 21 to move to its open, striker release position, wherein swing door 12 can be moved to a fully open state, also referred to as open position. A pawl biasing member 49, such as a suitable spring, is provided to normally bias pawl 23 toward its ratchet holding position.

Figure 3:
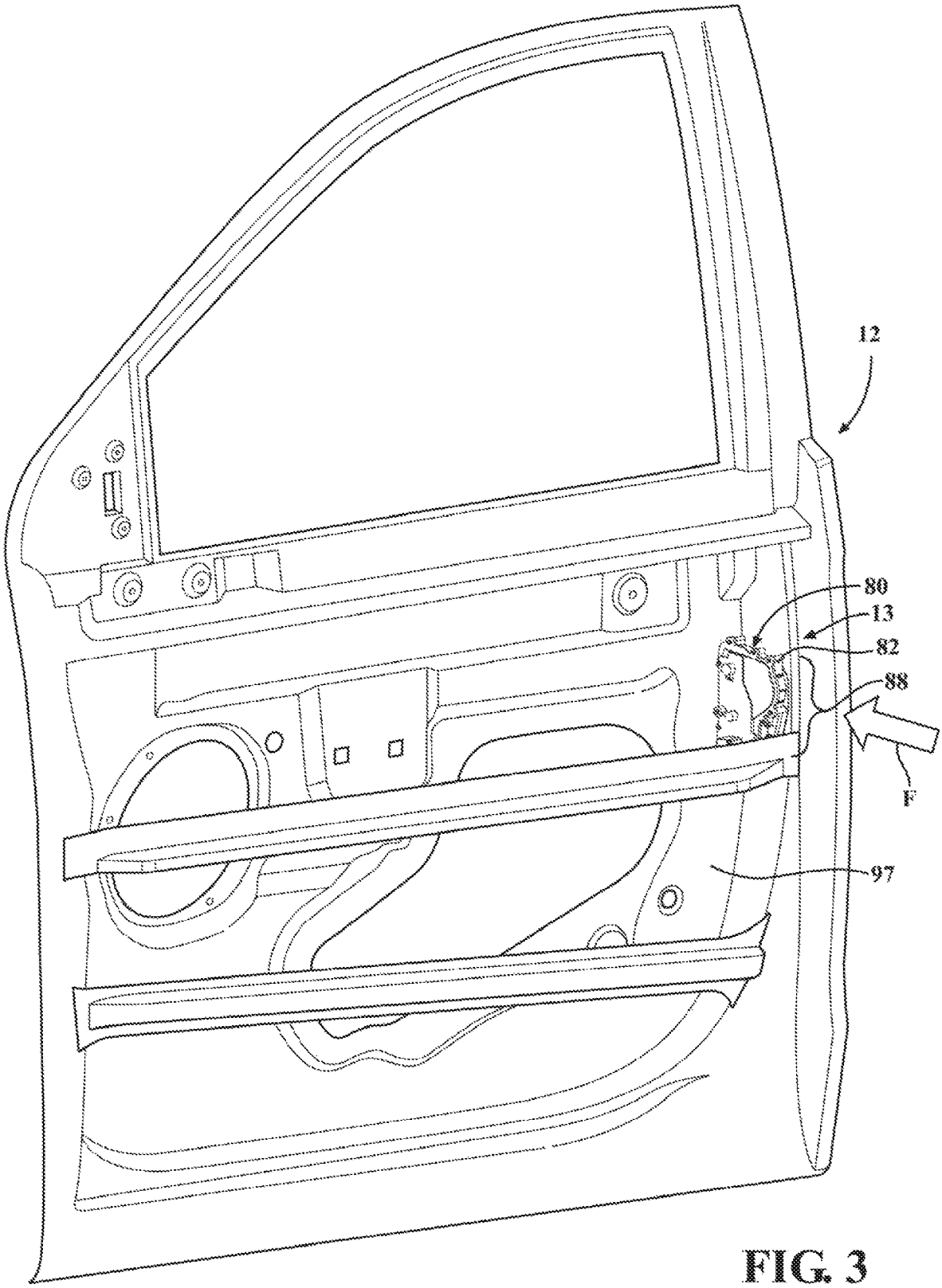
FIG. 3 is a side view of the passenger swing door of associated with the vehicle shown in FIG. 1A with an outer door panel and other various components removed for clarity purposes only.
Figure 3A:
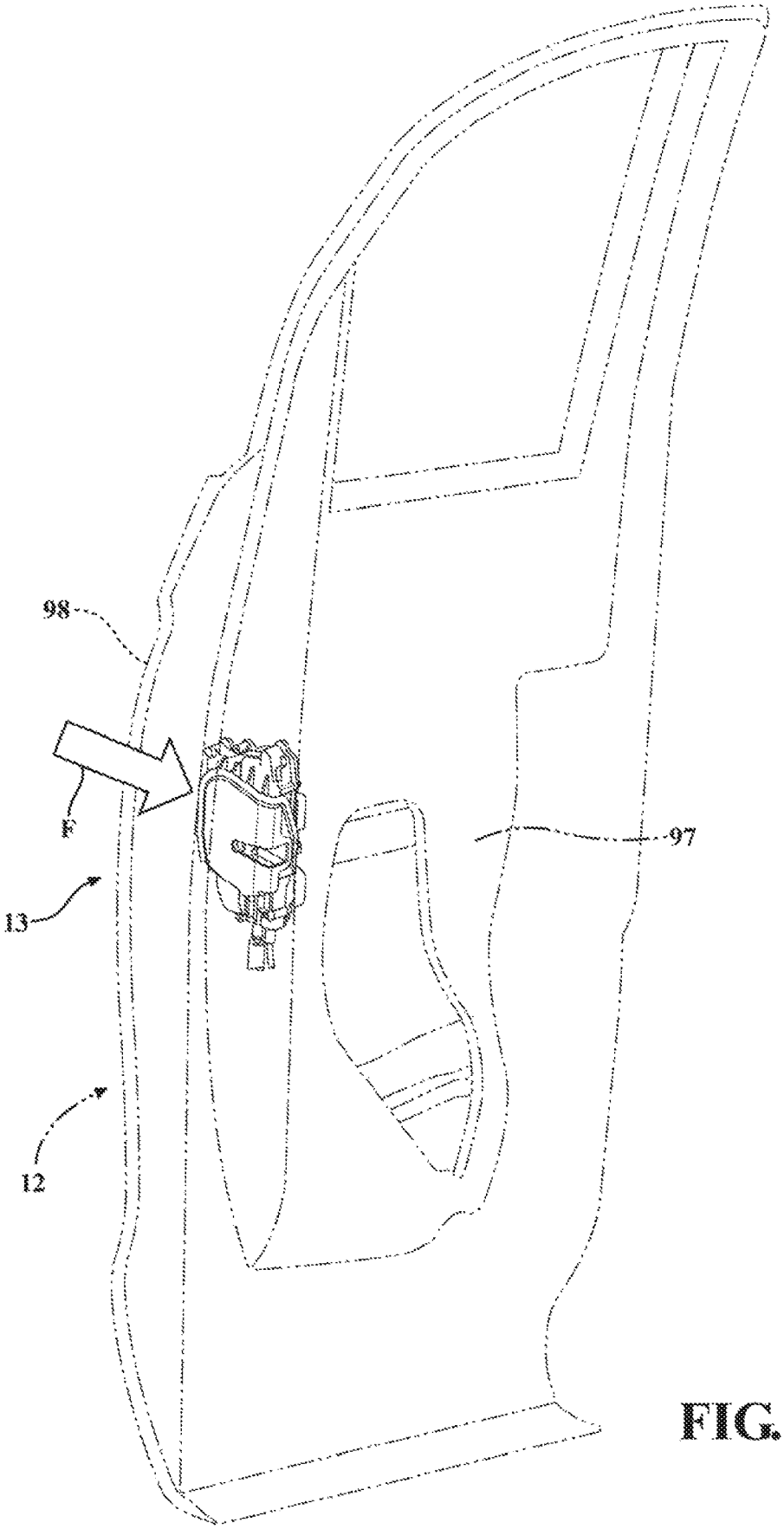
FIG. 3A is a perspective view of the passenger swing door of FIG. 3.
Figure 3B:
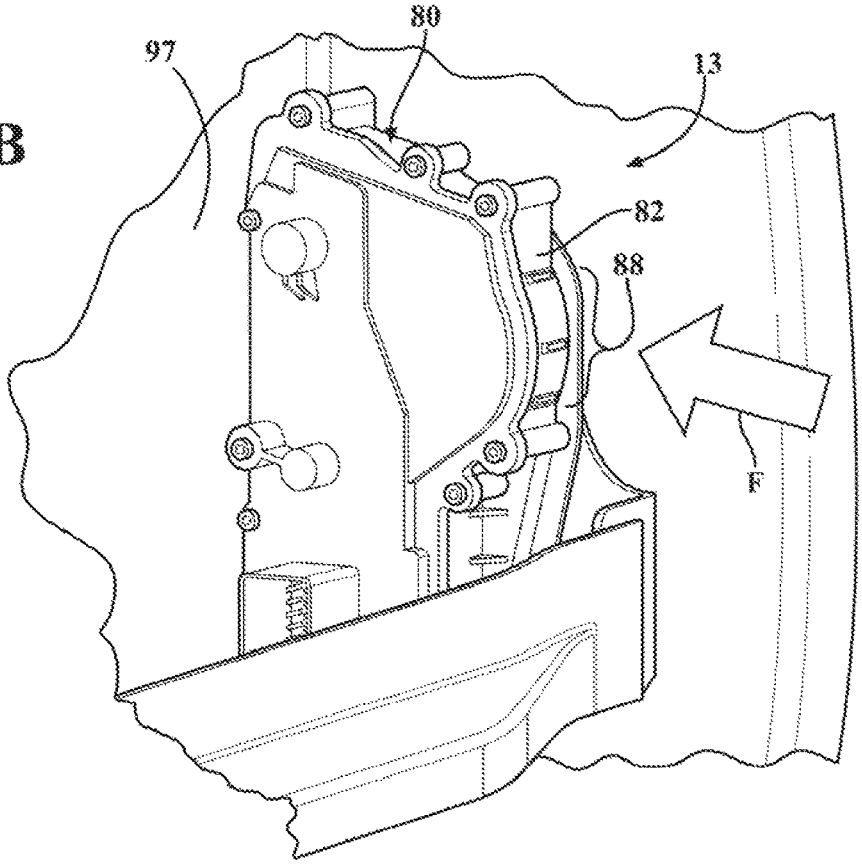
FIG. 3B is an enlarged partial view of the passenger swing door of FIG. 3 illustrating a power latch assembly thereof.
Figure 3C:
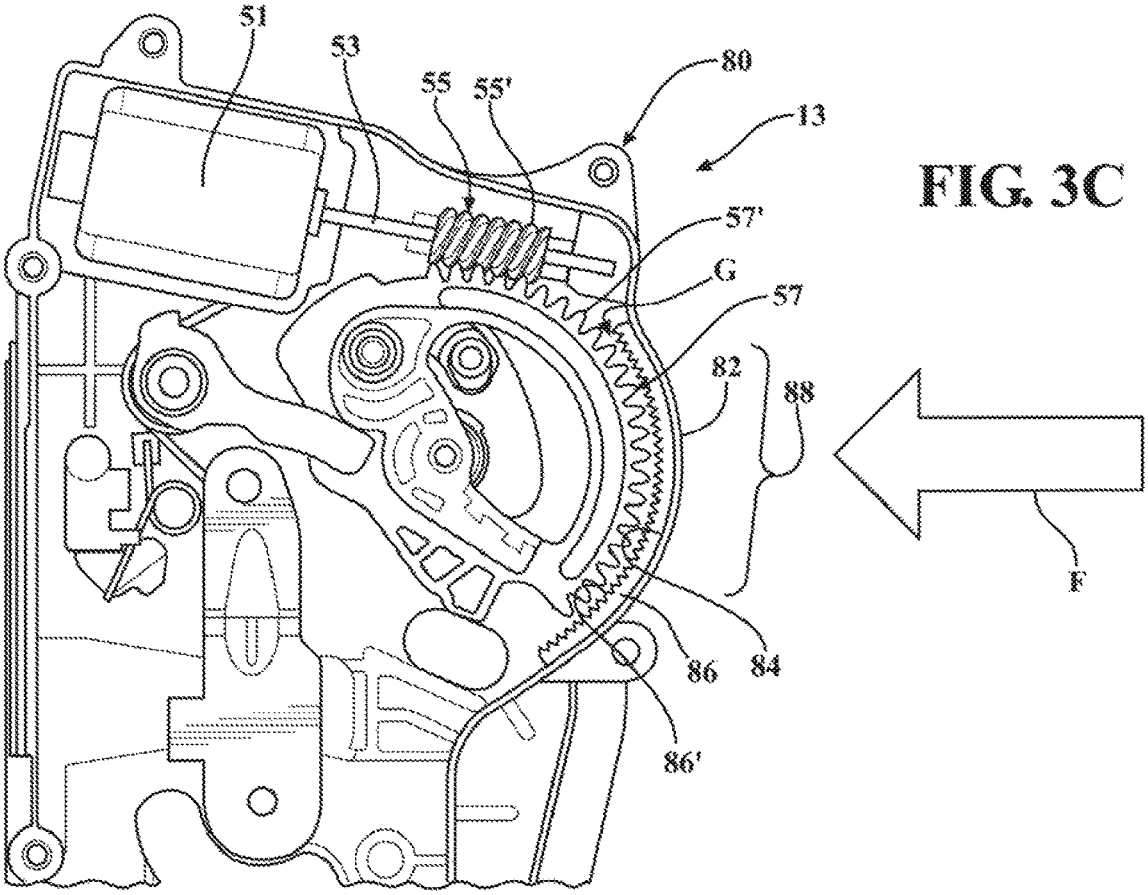
FIG. 3C is a view similar to FIG. 3B with a cover of removed from the power latch assembly.
Figure 3D:
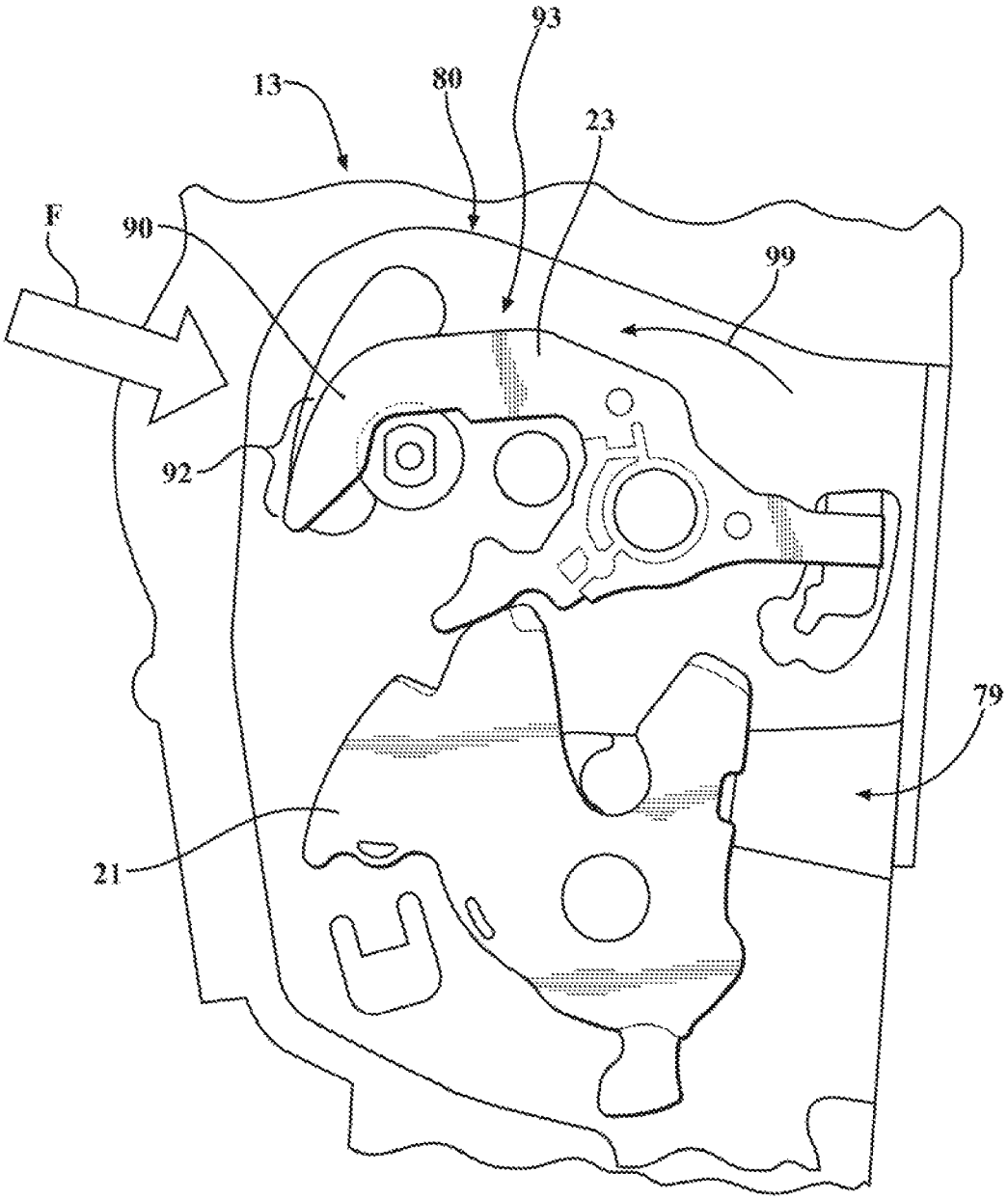
FIG. 3D is a view similar to FIG. 3C shown from an opposite side of the power latch assembly.
Figure 4:
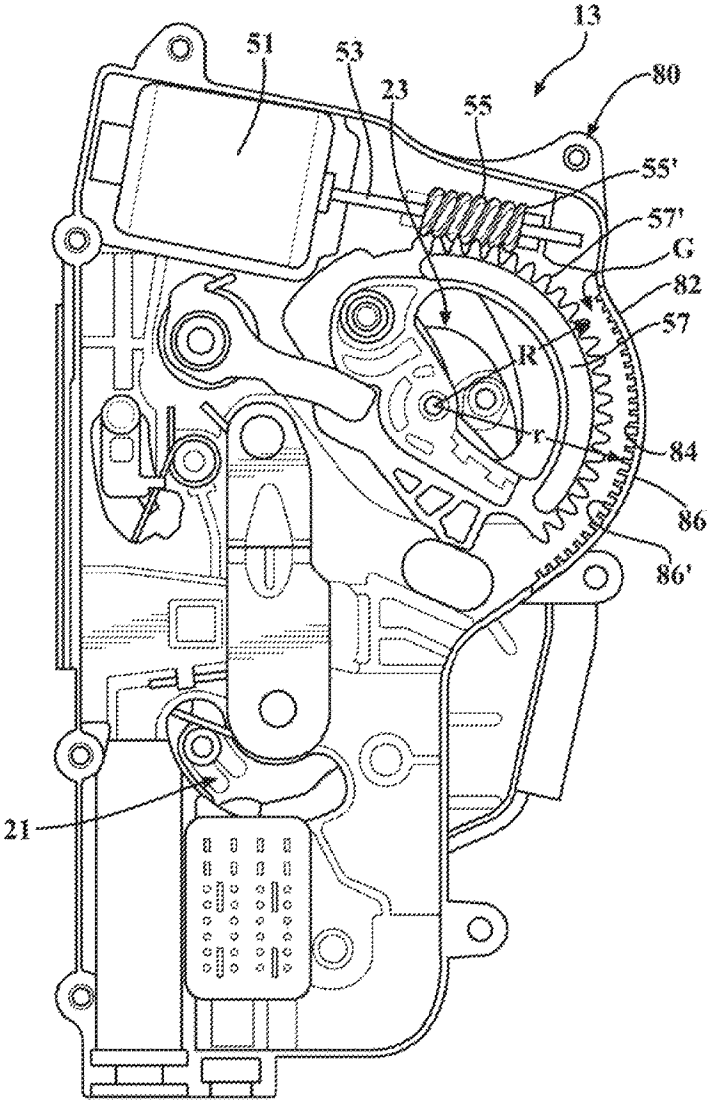
FIG. 4 is an enlarged plan view of the power latch assembly as shown in FIG. 3C.
Figure 4A:
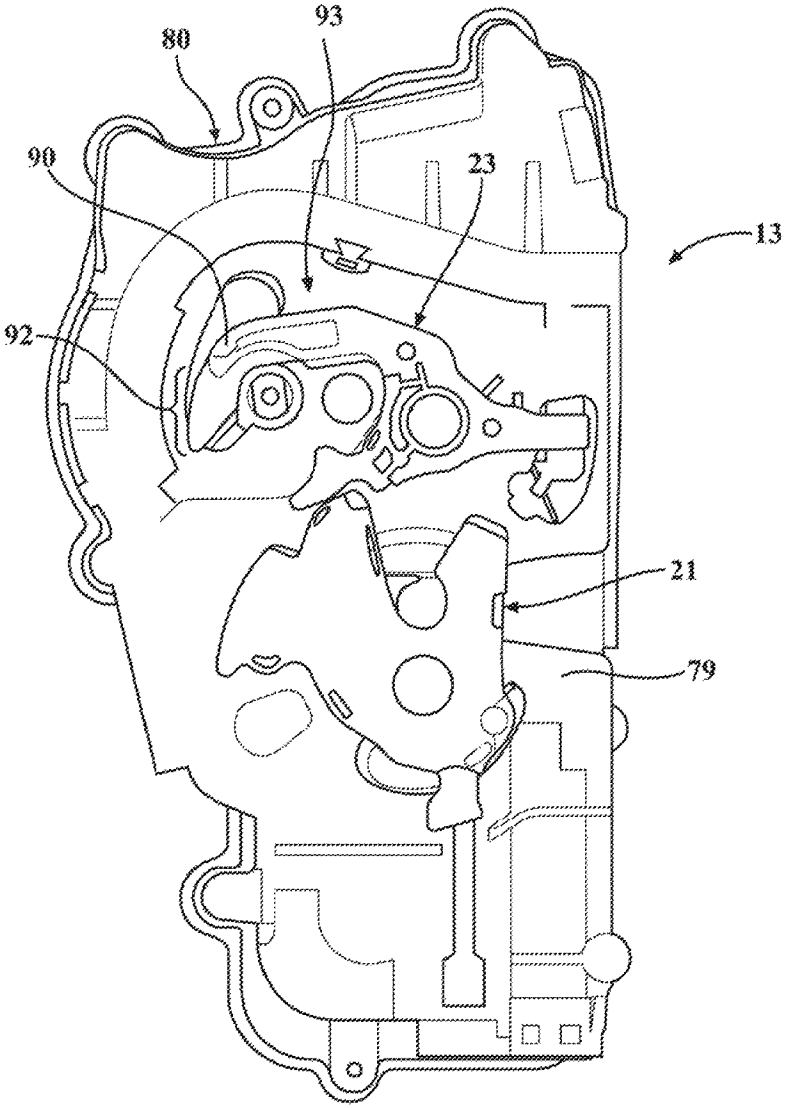
FIG. 4A is an enlarged plan view of the power latch assembly as shown in FIG. 3D.
Figure 5:
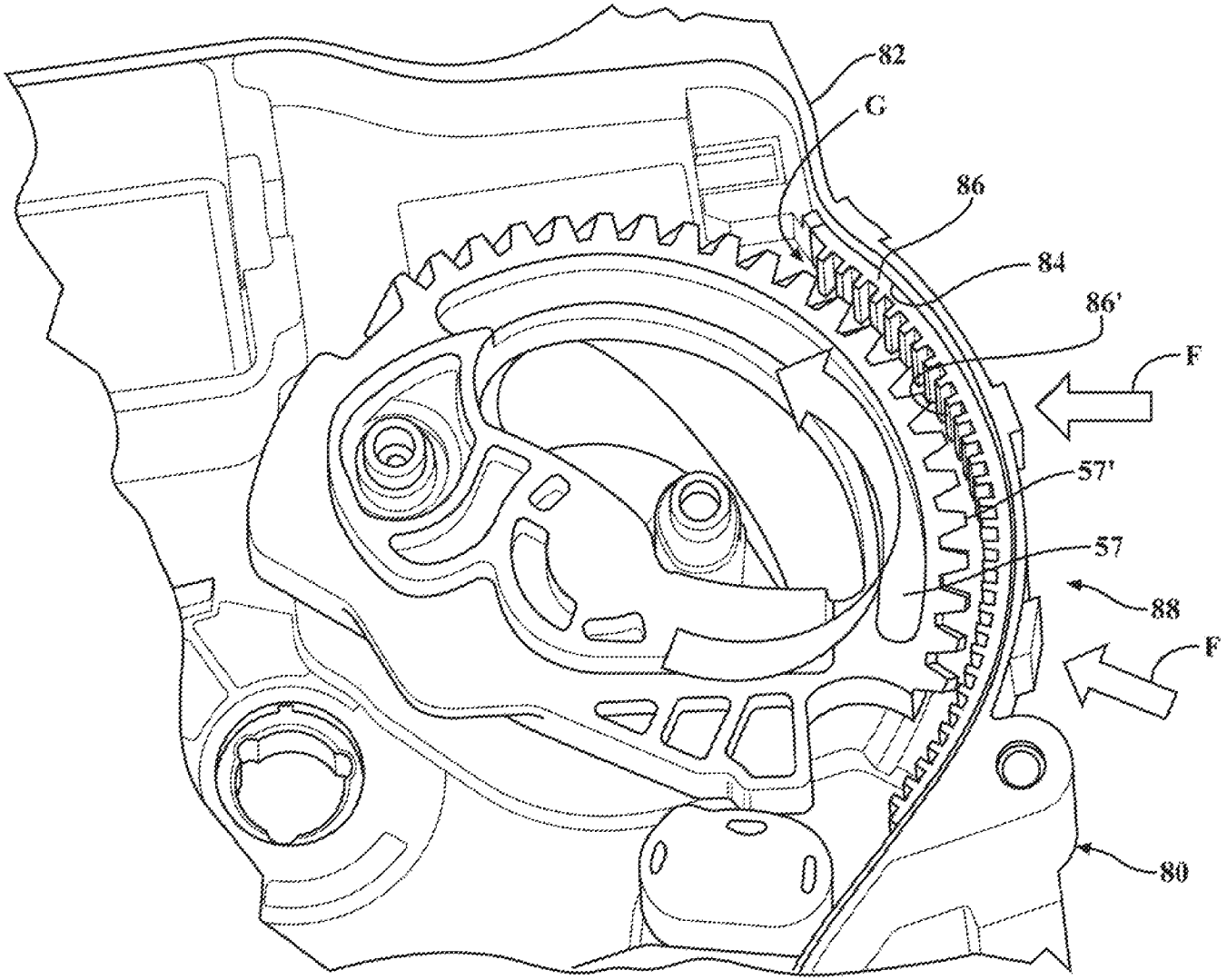
FIG. 5 is an enlarged partial plan view of the power latch assembly as shown in FIG. 4 with various components removed for clarity purposes only.

Pawl release lever 25 is operatively connected to pawl 23, either directly or indirectly, and is movable between a pawl release position whereat pawl release lever 25 moves pawl 23 to its ratchet releasing position, and a home position whereat pawl release lever 25 permits pawl 23 to be in its ratchet holding position. A release lever biasing member (not shown), such as a suitable spring, is provided to normally bias pawl release lever 25 toward its home position. Pawl release lever 25 can be moved to its pawl release position by several components, such as, for example, by power release actuator 29 and by inside door release lever 27. Power release actuator 29 includes a power release motor 51 having an output shaft 53, a power release worm gear 55 mounted or provided on output shaft 53, and a gear member, referred to hereafter as power release gear 57. Power release gear 57 has gear teeth 57' configured in meshed engagement with gear teeth, shown as a spiral or helical gear tooth 55', by way of example and without limitation, of power release worm gear 55. A power release cam 59 is connected for rotation with power release gear 57 and is rotatable between a pawl release range of positions and a pawl capture position, also referred to as pawl non-release range of positions. In FIGS. 1C, 3D and 4A, power release cam 59 is located in a position that is within the pawl non-release range, whereat ratchet 21 is maintained in the striker capture position. Power release gear 57 is selectively driven rotatably by power release worm gear 55 for driving power release cam 59, which, in turn, drives pawl release lever 25 from its home position into its pawl release position, as will be understood by a person possessing ordinary skill in the art of latches.

Power release actuator 29 can be used as part of a conventional passive keyless entry feature. When a person approaches vehicle 10 with an electronic key fob 60 (shown schematically in FIG. 2) and actuates the outside door handle 61, for example, sensing both the presence of key fob 60 and that door handle 61 has been actuated (e.g. via communication between a switch 63 (FIG. 1C) and a latch electronic control unit (ECU) shown at 67 (FIG. 1C) that at least partially controls the operation of power latch assembly 13). In turn, latch ECU 67 signals and actuates power release actuator 29 to cause the latch release mechanism, via driven rotation of power release gear 57 and power release cam 59 in an unlocking direction, to pivot pawl 23 to its ratchet releasing position to release ratchet 21 to move under the bias of ratchet biasing member 47 to its striker release position and shift power latch assembly 13 into an unlatched operating state so as to facilitate subsequent opening of swing door 12. Power release actuator 29 can be alternatively activated as part of a proximity sensor based entry feature (radar based proximity detection for example), for example when a person approaches vehicle 10 with an electronic key fob 60 (FIG. 2) and actuates a proximity sensor 58, such as a capacitive sensor, or other touch/touchless based sensor (based on a recognition of the proximity of an object, such as the touch/swipe/hover/gesture or a hand or finger, or the like), (e.g. via communication between the proximity sensor 58 (FIG. 1C) and an electronic latch control unit (ECU) shown at 67 (FIG. 1C) that at least partially controls the operation of closure latch assembly 13). In turn, latch ECU 67 signals power release actuator 29 to cause the latch release mechanism to release the latch mechanism and shift power latch assembly 13 into an unlatched operating state to facilitate subsequent opening of vehicle door 12. Also, power release actuator 29 can be used in coordinated operation with power-operated swing door actuator 22, as further described below. Further yet, outside door handle 61 may be configured for mechanical actuation of power latch assembly 13 to facilitate opening the swing door 12, as will be understood by a person possessing ordinary skill in the art of latches, such as, by way of example and without limitation, during power interruption and/or upon experiencing a crash condition, as discussed further below.

Figure 2:
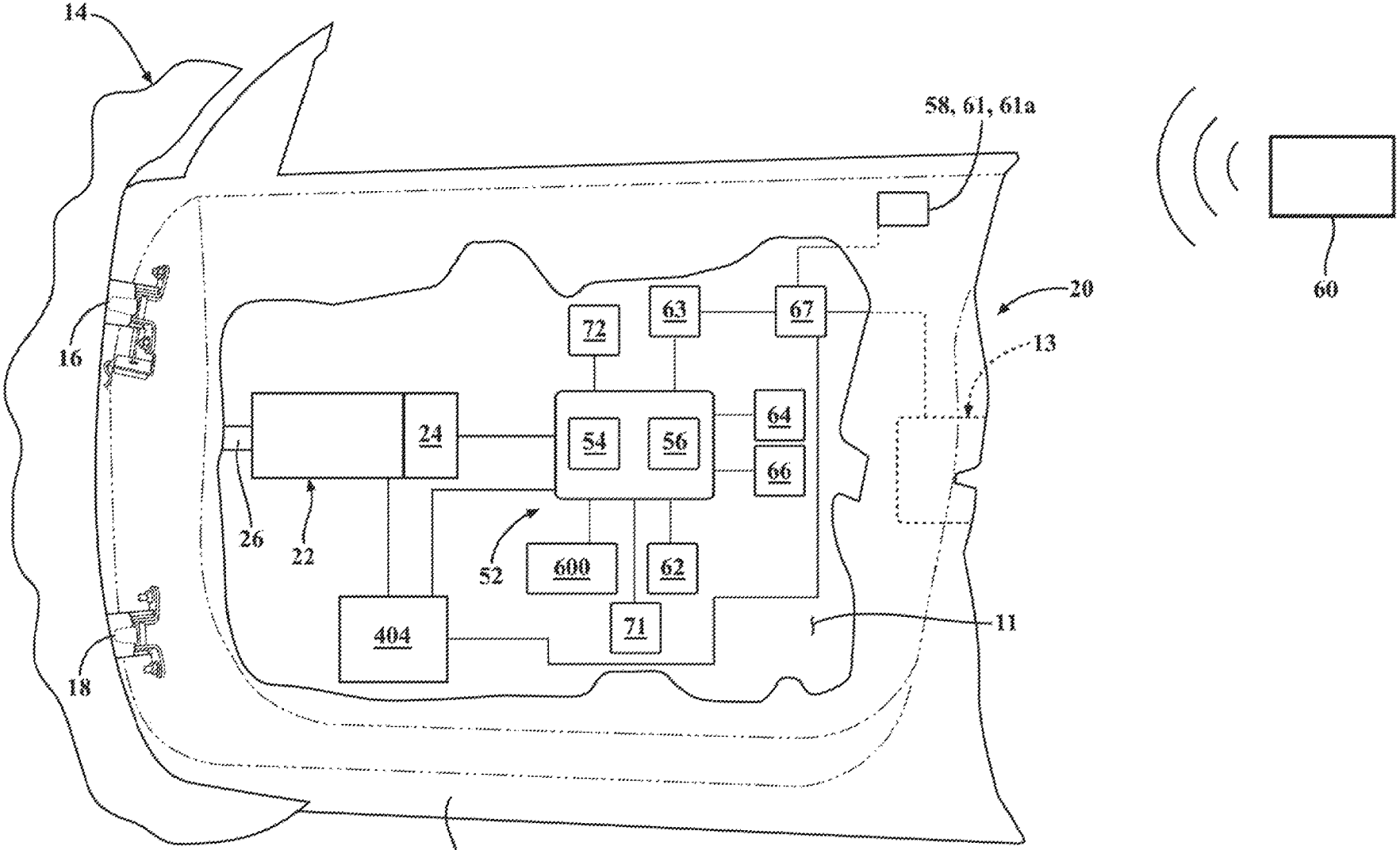
FIG. 2 is a diagrammatic view of the front passenger swing door shown in FIG. 1A, with various components removed for clarity purposes only, in relation to a portion of the vehicle body and which is equipped with the power door actuation system including a power latch assembly of the present disclosure.

Power-operated swing door actuator 22 can be mounted in door 12 and located near door hinges 16, 18 to provide for full or partial open/close movement of swing door 12 under actuation; to provide an infinite door check function; and to provide manual override (via a slip clutch) of power-operated swing door actuator 22, as desired. Power operated swing door actuator 22 can function to automatically swing door 12 about its pivot axis between its open and closed positions. Typically, power-operated swing door actuator 22 can include a power-operated device such as, for example, an electric motor 24 and a rotary-to-linear conversion device that are operable for converting the rotary output of the electric motor 24 into translational movement of an extensible member 26. In many power door actuation arrangements, the electric motor 24 and the conversion device are mounted to swing door 12 and a distal end of an extensible member 26 is fixedly secured to vehicle body 14 proximate the door hinges 16, 18. Driven rotation of the electric motor 24 causes translational movement of the extensible component 26, which, in turn, controls pivotal movement of passenger door 12 relative to vehicle body 14. As also shown, the ECU 52 is in communication with electric motor 24 for providing electric control signals thereto for control thereof. As shown in FIG. 2, ECU 52 can include hardware such as a microprocessor 54 and a memory 56 having executable computer readable instructions stored thereon for implementing the control logic stored as a set of computer readable instructions in memory 56 for operating the power door actuation system 20.

Now referring back to FIGS. 1B and 1C, the door 12 may have a conventional opening lever or inside door handle 61*a* located on an interior facing side of the door 12 facing the inside of the passenger compartment 7 for opening the door 12 (e.g. including unlocking and opening the power latch assembly 13, as well as commanding operation of the power-operated swing door actuator 22). This opening lever or inside door handle 61*a* can trigger a switch 63*a* connected operably to the latch ECU 67 such that, when the switch 63*a* is actuated, the latch ECU 67 signals and facilitates power latch assembly 13 being activated. Subsequently, the latch ECU 67 may facilitate that the power-operated swing door actuator 22 is activated (i.e. the extension member 26 is deployed or extended) to continue the automatic opening of the swing door 12. In the alternative, the power-operated swing door actuator 22 may be powered on at a point before the final presentment position is reached so as to provide a seamless transition between the two stages of door opening (i.e. both motors are overlapping in operation for a short time period). Alternatively, the latch ECU 67 may facilitate that the power-operated swing door actuator 22 is operated as a door check (i.e. the extension member 26 is deployed or extended and maintained at such a deployed or extended condition) until the user manually takes control of the swing door 12 to further open it to a fully opened position. Further yet, inside door handle 61*a* may be configured for mechanical actuation of power latch assembly 13, via intervening mechanical mechanism(s), to facilitate opening the swing door 12, as will be understood by a person possessing ordinary skill in the art of latches, such as during power interruption and/or upon experiencing a crash condition, as discussed further below.

Now referring back to FIG. 1A, the power door actuation system 20 and the power latch assembly 13 are electrically connected to a main power source 400 of the motor vehicle 10, for example a main battery providing a battery voltage $V_{batt}$ of 12 V, through an electrical connection element 402, for example a power cable (the main power source 400 may equally include a different source of electrical energy within the motor vehicle 10, for example an alternator). The electronic latch ECU 67 and/or swing door ECU 52 are also coupled to the main power source 400 of the motor vehicle 10, so as to receive the battery voltage $V_{batt}$; the electronic latch ECU 67 and/or swing door ECU 52 are thus able to check if the value of the battery voltage $V_{batt}$ decreases below a predetermined threshold value, to promptly determine if an emergency condition (when a backup energy source may be needed) occurs.

As shown in the schematic block diagram of FIG. 1A and FIG. 2, a backup energy source 404, which may be integrated forming part of an electronic control circuit of the electronic latch ECU 67 and/or swing door ECU 52, or may be separate therefrom, is configured to supply electrical energy to the power door actuation system 20 and/or the power latch assembly 13, and to the same electronic control circuit of the electronic latch ECU 67 and/or swing door ECU 52, in case of failure or interruption of the main power supply from the main power source 400 of the motor vehicle 10.

In an illustrative example, the backup energy source 404 includes a group of low voltage supercapacitors (not shown) as an energy supply unit (or energy tank) to provide power backup to the power door actuation system 20 and/or the power latch assembly 13, even in case of power failures. Supercapacitors may include electrolytic double layer capacitors, pseudocapacitors or a combination thereof. Other electronic components and interconnections of a backup energy source 404, such as a boost module to increase the voltage from the backup energy source 404 to an actuator, such as the power-operated swing door actuator for example, are disclosed in co-owned patent application US2015/0330116, which is incorporated herein by way of reference in its entirety.

Now referring back to FIG. 2, illustrated are one or more sensors 71 communicating with swing door ECU 52 for providing requisite information. It is recognized that sensors 71 can be any number of sensor types (e.g. Hall sensor, presence sensors such as anti-pinch strips, capacitive, ultrasonic, radar, mechanical switches, location sensors, etc.). Although not expressly illustrated, electric motor 24 of power-operated swing door actuator 22 can include sensors for monitoring a position of vehicle door 12 during movement between its open and closed positions. As is also schematically shown in FIG. 2, swing door ECU 52 can be in communication with remote key fob 60 via a fob transreceiver module 600 or internal/external handle switch 63, 63*a*, or proximity sensor 58 for receiving a request from a user to open or close vehicle door 12. Put another way, swing door ECU 52 receives a command signal from either remote key fob 60 and/or internal/external handle switch 63, 63*a*, and/or proximity sensor 58 to initiate an opening or closing of vehicle door 12. It is also recognized that a body control module 72 (having memory with instructions for execution on a computer processor) mounted in vehicle body 14 of vehicle 10 can send the open or close request to swing door ECU 52 and electronic latch ECU 67.

Swing door ECU 52 can also receive an additional input from a proximity sensor 64 (e.g. ultrasonic or radar) positioned on a portion of swing door 12, such as on a door mirror 65, or the like, as shown in FIG. 1A. Proximity sensor 64 assesses if an obstacle, such as another car, tree, post, or otherwise, is near or in close proximity to vehicle door 12. If such an obstacle is present, proximity sensor 64 will send a signal to swing door ECU 52, and swing door ECU 52 will proceed to turn off electric motor 24 to stop movement of swing door 12, and thus prevent vehicle door 12 from hitting the obstacle.

A non-limiting embodiment of power latch assembly 13 will now be further described with reference to FIGS. 3-6, wherein various components have been removed for clarity only and to better illustrate aspects discussed hereafter. The power latch assembly 13 includes the outer housing, also referred to as casing, support member, and referred to hereafter as housing 80, configured to support various components therein, such as, by way of example and without limitation, power release actuator 29; power release gear 57; ratchet 21, and pawl 23. The housing 80 has an outermost wall, referred to hereafter as outer wall 82, with an inner surface 84 that bounds and conforms closely with immediately adjacent internal components (providing a minimal clearance fit therewith) to provide as small a package size and minimal weight of power latch assembly 13 as possible. As such, the outer wall 82 is illustrated as having inner surface 84 configured to face inwardly toward passenger compartment 7, with inner surface 84 extending in close relation, but slightly spaced relation from power release gear 57 so as to not interfere with the desired and intended rotation of power release gear 57 during normal use. As such, rotation of the worm gear 55, as driven by selectively energized power release motor 51, causes the power release gear 57 to rotate and pivot pawl release lever 25 to rotate pawl 23 to move between its ratchet holding and ratchet releasing positions, as discussed above.

Figure 3E:
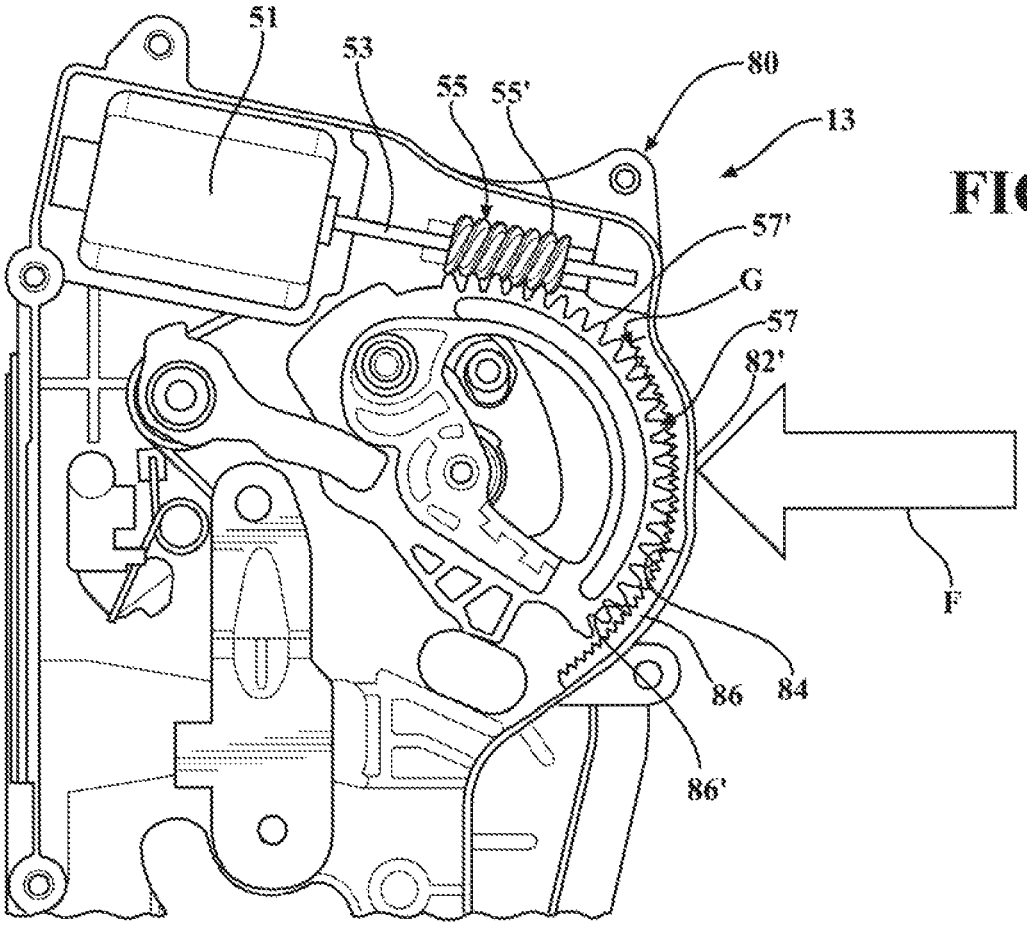
FIG. 3E is a view similar to FIG. 3C illustrating a deformation of the housing of the power latch assembly as a result of an impact force.

The power latch assembly 13 further includes a mechanical feature, referred to hereafter as anti-rotation member 86 (FIGS. 3C, 4 and 5), disposed in the housing 80 and constructed in accordance with one aspect of the disclosure to inhibit unwanted, inadvertent release of ratchet 21 from the striker capture position during sudden impact to the power latch assembly 13. The mechanical feature described herein provided internal the housing 80 allows the housing 80 to maintain a standard foot print, size and shape, and without requiring to enlarge the housing 80 footprint, or requiring additional components and/or levers to extend from the housing 80 requiring additional packaging space within the swing door 12. The anti-rotation member 86 is configured extending along a portion 88 of the inner surface 84 of housing 80 in radially aligned, radially outwardly spaced relation with the gear teeth 57' of power release gear 57. The portion 88 of housing 80 is shown as being arcuate, having a second radius of curvature (r) similar to that as a first radius of curvature (R) of power release gear 57, with second radius of curvature r shown being configured in radially outwardly spaced, generally concentric relation with first radius of curvature R. Portion 88 is oriented to face laterally outwardly from the vehicle swing door 12 and away from passenger compartment 7, such that if one could see through an outer panel 98 of vehicle swing door 12 they would see portion 88, such that portion 88 is a portion of swing door 12 that is typically impacted via an impact force, identified by arrows (F), in a side-impact of swing door 12, such as in a crash condition. It is understood that the force F may influence the latch assembly 13 from other directions. The anti-rotation member 86 is shown as having nubs or protrusions, also referred to and shown as teeth 86', extending radially inwardly from inner surface 84. Teeth 86' follow the arcuate radius of curvature r of portion 88 and are configured for interlocking, meshed engagement with teeth 57' of power release gear 57 upon portion 88 being impacted and elastically and/or plastically deformed radially inwardly by force F during a crash condition. It is to be understood that the respective teeth 57', 86' remain radially spaced out of contact from one another during normal use, such as by a gap G extending therebetween of about 1-5 mm, by way of example and without limitation. Teeth 57', 86' only become engaged in meshed frictional contact, and ultimately interlocked with one another, upon anti-rotation member 86 being impacted by force F and teeth 86' being pushed inwardly toward passenger compartment 7 via impact of portion 88 and deformation of inner surface 84 by force F during a crash condition sufficient to elastically and/or plastically deform the section 88 of the outer wall 82, illustrated as deformed outer wall 82' in FIG. 3E of housing 80 inwardly toward passenger compartment 7 and toward an inner panel 97 of vehicle swing door 12. The anti-rotation member 86 can be formed as a monolithic piece of material with housing 80, such as in a molding or forging process, by way of example and without limitation, or the anti-rotation member 86 can be formed as a separated piece of material and subsequently fixed to the inner surface 84 of the housing 80, such as via an adhesive, mechanical fixation mechanism, weld joint, and/or otherwise. It is to be understood that housing 80 can be formed of any desired polymeric or metal material desired for the intended application, while the anti-rotation member 86 can also be formed of any desired polymeric or metal material desired for the intended application, including rubber, by way of example and without limitation. Regardless of the materials used to form the housing 80 and anti-rotation member 86, when the teeth 57', 86' are brought into locking contact with one another upon mechanically deforming the inner surface 84 of the portion 88 of housing 80 in a crash condition, the anti-rotation member 86 at least temporarily prevents (as long as teeth 57', 86' are intermeshed) unwanted rotation of the power release gear 57 that could otherwise tend to bias the pawl 23 to the ratchet releasing position. As such, during a side impact of motor vehicle 10, anti-rotation member 86 prevents inadvertent movement of the pawl release lever 25 sufficiently enough to cause pawl 23 to rotate from the ratchet holding position to the ratchet releasing position. Accordingly, pawl 23 is maintained in the ratchet holding position during and throughout a crash condition via interlocked teeth 57', 86', facilitated by teeth 57', 86' extending alone similar or same radii of curvature r, R, thereby ensuring a plurality of the teeth 57', 86' become interlocked with one another upon teeth 86' being pushed inwardly. As such, pawl 23 remains in its ratchet holding position as long as the swing door 12 is not intended to be opened via intentional actuation of a release mechanism and intermeshed engagement of teeth 57', 86' with one another, as discussed above and as illustrated in FIG. 3E.

It is to be recognized that the power latch assembly 13 is intended to be selectively actuatable to release the pawl 23 from its closed, ratchet holding position, thereby allowing the ratchet 21 to be moved to the open, striker releasing position to allow the swing door 12 to be intentionally opened after the crash condition. The actuation of power latch assembly 13 while the power release gear teeth 57' and anti-rotation member teeth 86' are engaged and locked with one another can occur via mechanically actuated operation, such as by selective actuation of mechanically actuatable outside and/or inside door handles 61, 61*a*, when desired to open swing door 12 after an accident. Accordingly, any inability of power release gear 57 to rotate relative to housing 80 does not prevent the swing door 12 from being able to be selectively opened, when desired.

Figure 3F:
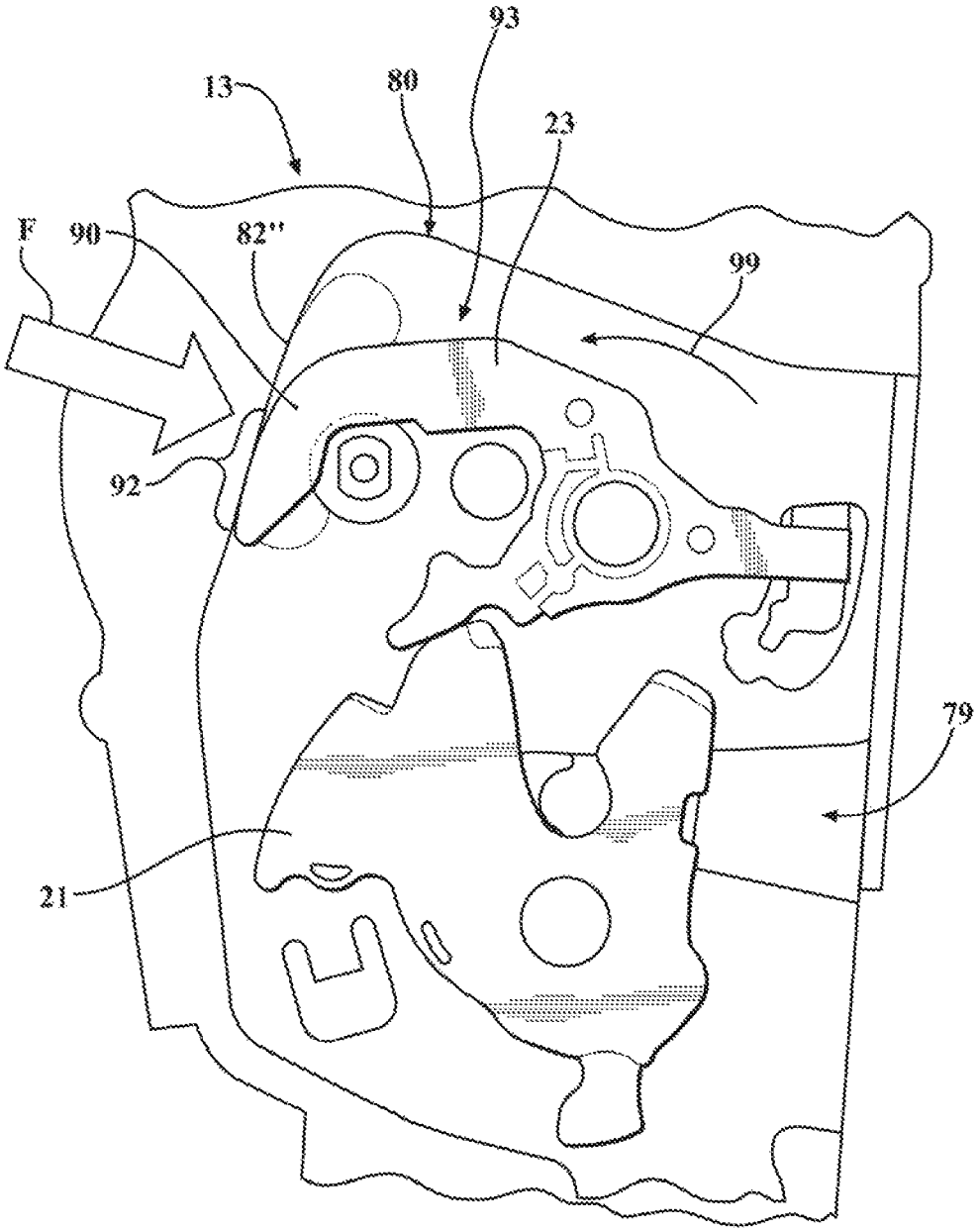
FIG. 3F is a view similar to FIG. 3D illustrating a deformation of the housing of the power latch assembly as a result of an impact force.
Figure 6:
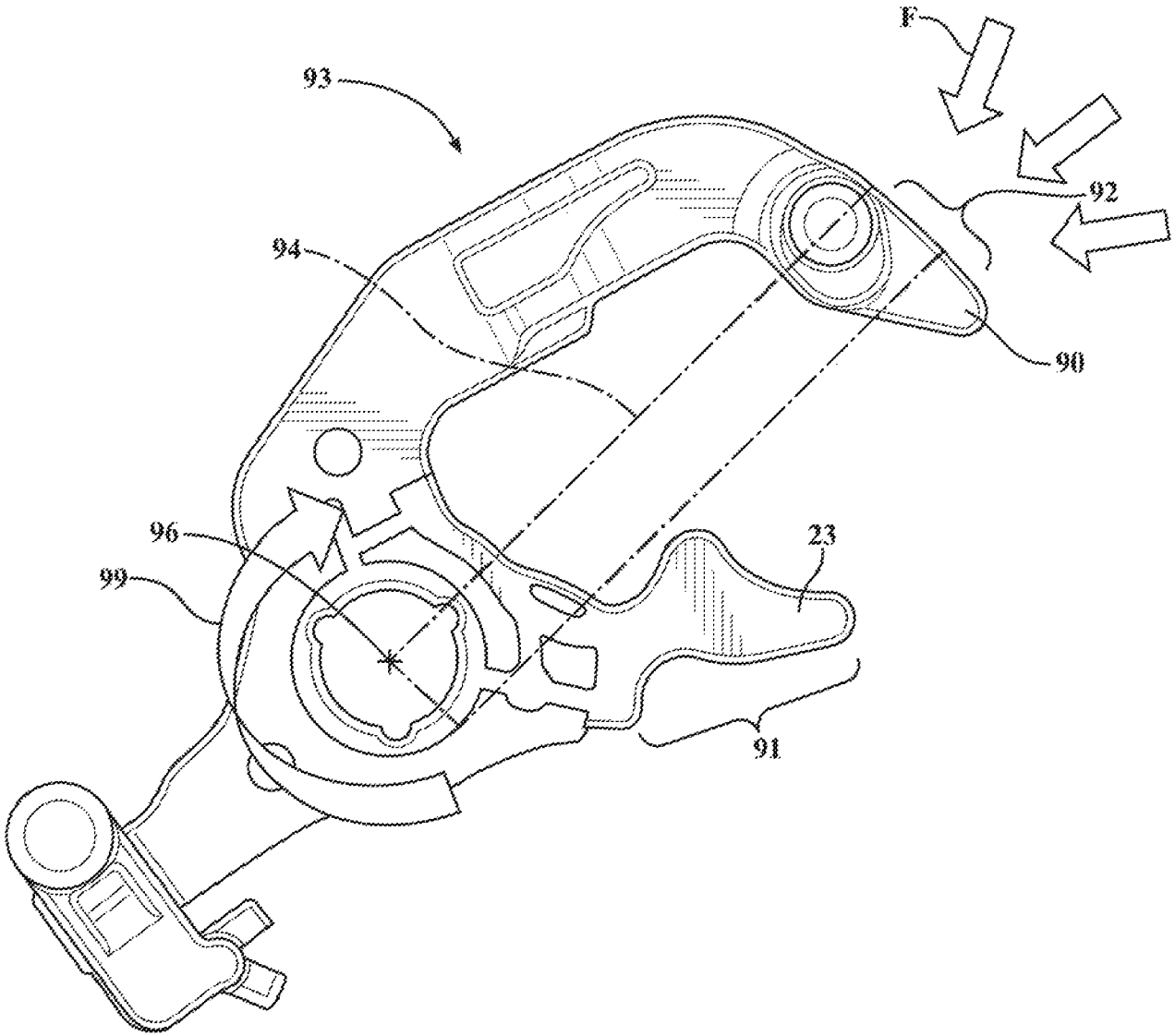
FIG. 6 is an enlarged view illustrating a pawl of the power latch assembly in accordance with a further aspect of the disclosure.

In accordance with yet a further aspect, the pawl 23 can be provided having a mechanical feature fixed thereto in the form of an elongate lever arm extension portion, also referred to as elongate extension member 90, to facilitate maintaining the ratchet 21 in the striker capture position during a crash condition. The elongate extension member 90 can be fixed to pawl 23 as a monolithic piece of material with pawl 23, or as a separate piece of material fixed to pawl 23, such as via a suitable adhesive, mechanical fixation mechanism, weld joint, or otherwise. Elongate extension member 90 has a generally C-shaped body portion 93 with a first end region 91 (FIG. 6) of the generally C-shaped body portion 93 extending in a first direction from a center-of-rotation 96 of the pawl 23, with first end region 91 providing an active region of pawl 23 configured for operable locking engagement with the ratchet 21 while in a ratchet holding position to maintain the ratchet 21 in the closed, striker capture position and for operable disengagement from the ratchet 21 while in a ratchet releasing position to allow the ratchet 21 to move to the open, striker release position. Another of the end regions, shown as a free second end region 92, opposite first end region 91, of the generally C-shaped body portion 93 extends in a second direction, different from the first direction of first end region 91, from the center-of-rotation 96 of the pawl 23, with free second end region 92 forming an inactive region (inactive is intended to mean that the region does not provided a function during normal use of pawl 23 and power latch assembly 13) configured to mechanically bias the pawl 23 toward the ratchet holding position in a vehicle side-impact crash condition. The free second end region 92 is configured to project through and beyond an over-center radial axis 94 that extends through the center-of-rotation 96 of the pawl 23 laterally outwardly from inner panel 97 toward outer panel 98 of the swing door 12. Accordingly, the C-shaped body portion 93 of extension member 90 is oriented to extend from axis 96 laterally outwardly toward the outer panel 98 of swing door 12, into close proximity therewith, such as between about 1-25 mm, by way of example and without limitation, such that free second end region 92 is necessarily impacted in a side-impact vehicle crash condition upon outer panel 98 being deformed inwardly toward inner panel 97. Impact of the outer panel 98 of the swing door 12 in a side-impact vehicle crash condition causes the free end region 92 to be influenced, for example impacted by the portion 88 of housing 80, for example by deformed wall 82" as an illustrative example as illustrated in FIG. 3F, upon a deformation, breakage or large crack in the portion 88 of the inner surface 84 of housing 80, whereupon pawl 23 is biased via torque force F acting on free second end region 92 in a ratchet holding direction of rotation, indicated by arrow 99 (FIGS. 3D and 6). Alternatively, the direction of impact reaction forces, and example of another force of influence acting on the latch assembly 13, creates a rotational eccentricity with respect to the center-of-rotation 96 of the unbalanced pawl 23 (being imbalanced due to the presence of the C-shaped body portion 93) in the case where the impact does not cause a breakage of the portion 88 of housing 80 resulting in the impact upon the free second end region 92 by the portion 88 of the inner surface 84, whereupon pawl 23 is caused to move and be biased in the ratchet holding direction of rotation, indicated by arrow 99. Accordingly, pawl 23 is prevented from being inadvertently rotated in the ratchet releasing direction during a crash event due to being impacted. While illustratively the teachings herein are described with reference to one component of a release chain, the pawl 23 in accordance with an illustrative example only, being prevented from being inadvertently rotated or moved in the ratchet releasing direction during a crash event due to an impact, it is understood that other release chain components may be prevent from moving in a similar manner. Additionally, the teachings herein may be applied to the ratchet 31 itself to prevent the ratchet from releasing the striker 37 during a crash condition.

Figure 7:
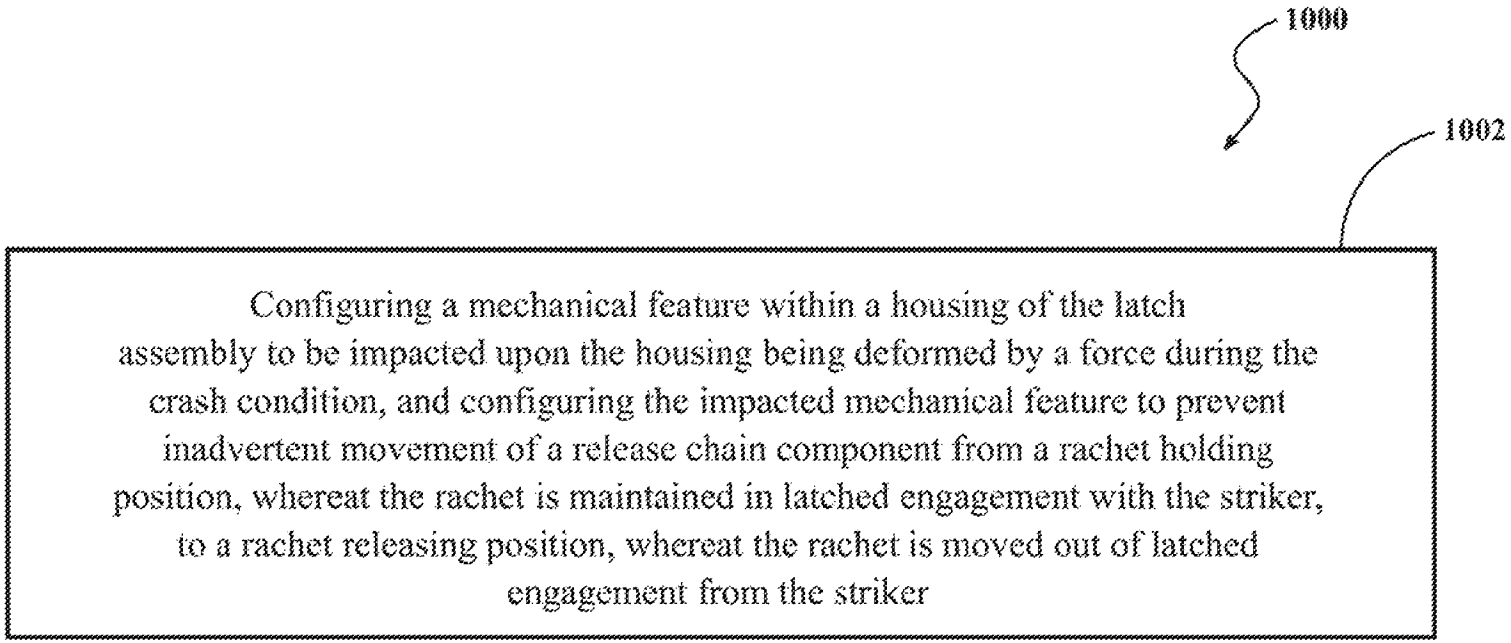
FIG. 7 illustrates a flow chart of a method of preventing a ratchet of a latch assembly of a motor vehicle swing door from inadvertently moving from a striker capture position, in accordance with an illustrative embodiment.

Now referring to FIG. 7, there is illustrated a method of preventing a ratchet of a latch assembly of a motor vehicle swing door from inadvertently moving from a striker capture position 1000. Including the step of configuring a mechanical feature within a housing of the latch assembly to be impacted upon the housing being deformed by a force during the crash condition, and configuring the impacted mechanical feature to prevent inadvertent movement of a release chain component from a ratchet holding position, whereat the ratchet is maintained in latched engagement with the striker, to a ratchet releasing position, whereat the ratchet is moved out of latched engagement from the striker 1002.

The foregoing description of the embodiments has been provided for purposes of illustration and description. It is not intended to be exhaustive or to limit the disclosure. Individual elements, assemblies/subassemblies, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A latch assembly for a motor vehicle, the motor vehicle having a vehicle body defining a door opening and a vehicle swing door pivotably connected to the vehicle body for swing movement between an open position and a closed position relative to the vehicle body and a passenger compartment, the latch assembly comprising:

a housing having a portion configured to face laterally outwardly from the passenger compartment, said portion having an inner surface configured to face inwardly toward the passenger compartment;

a ratchet disposed in said housing for movement between a striker capture position to retain the vehicle swing door in the closed position and a striker release position to allow the vehicle swing door to be moved to the open position;

a pawl disposed in said housing and configured for release from a ratchet holding position, whereat said ratchet is maintained in latched engagement with a striker in the striker capture position to maintain the vehicle swing door in the closed position, to a ratchet releasing position, whereat said ratchet is moved out of latched engagement from the striker to allow the vehicle swing door to be moved from the closed position to the open position;

a latch release mechanism forming a release chain for moving the pawl from the ratchet holding position to the ratchet releasing position; and a mechanical feature disposed in said housing, the mechanical feature being configured to be moved by a force generated during a crash condition of the motor vehicle, whereupon the movement of said mechanical feature during the crash condition prevents inadvertent movement of said release chain to prevent movement of said pawl from the ratchet holding position to the ratchet releasing position.

2. The latch assembly of claim 1, further including an electric motor configured to drive a power release gear in response to selective energization of said electric motor to move said pawl between the ratchet holding position and the ratchet releasing position, wherein said mechanical feature includes an anti-rotation member fixed to said inner surface of said housing, wherein said anti-rotation member is maintained in clearance relation with said power release gear during a normal operating condition of the motor vehicle, and wherein said anti-rotation member is brought into locked engagement with said power release gear upon said inner surface being deformed by the force generated during the crash condition, whereat said anti-rotation member prevents rotation of said power release gear, thereby preventing inadvertent movement of said pawl from the ratchet holding position to the ratchet releasing position.

3. The latch assembly of claim 2, further including a worm gear fixed to an output shaft of said electric motor, said worm gear being configured in meshed engagement with said power release gear.

4. The latch assembly of claim 2, wherein said anti-rotation member is fixed to said inner surface of said housing in radially aligned relation with said power release gear.

5. The latch assembly of claim 4, wherein said anti-rotation member includes teeth configured to mesh with teeth of said power release gear upon said inner surface being deformed.

6. The latch assembly of claim 5, wherein said teeth of said anti-rotation member extend along a first radius and said teeth of said power release gear extend along a second radius, wherein said first radius and said second radius are substantially the same.

7. The latch assembly of claim 6, wherein a plurality of said teeth of said anti-rotation member are configured to interlock with a plurality of said teeth of said power release gear upon said inner surface being deformed.

8. The latch assembly of claim 7, wherein said anti-rotation member is polymeric.

9. The latch assembly of claim 1, wherein said mechanical feature includes an elongate extension member fixed to said pawl, said elongate extension member having a first end region extending in a first direction from a center-of-rotation of said pawl to provide an active region of said pawl configured for operable locking engagement with said ratchet while in the ratchet holding position and for operable disengagement from said ratchet while in the ratchet releasing position, and a second end region extending in a second direction from said center-of-rotation of said pawl, different from said first direction of said first end region, to provide an inactive region configured to mechanically bias said pawl toward the ratchet holding position upon said inner surface of said housing being deformed by the force generated in the crash condition.

10. The latch assembly of claim 9, wherein said elongate extension member has a generally C-shaped body portion extending from said first end region to said second end region, and wherein said second end region extends through and beyond a radial axis that extends through said center-of-rotation of said pawl.

11. The latch assembly of claim 1, wherein said mechanical feature is disposed in said housing adjacent said inner surface and is configured to be impacted when said inner surface of said housing is deformed by the force generated in the crash condition of the motor vehicle.

12. The latch assembly of claim 1, wherein the latch assembly is configured to be mechanically actuated by a handle connected to the latch assembly to move the pawl from the ratchet holding position to the ratchet releasing position after the crash condition.

13. The latch assembly of claim 12, wherein the handle is an inside door handle.

14. The latch assembly of claim 12, wherein the handle is an outside door handle.

* * * * *